US009066640B2

(12) United States Patent
Iles et al.

(10) Patent No.: US 9,066,640 B2
(45) Date of Patent: Jun. 30, 2015

(54) CLEANER HEAD

(75) Inventors: Jean-Paul Mark Iles, Malmesbury (GB); Spencer James Robert Arthey, Malmesbury (GB); Scott Andrew Maguire, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 191 days.

(21) Appl. No.: 13/520,983

(22) PCT Filed: Dec. 2, 2010

(86) PCT No.: PCT/GB2010/052008

§ 371 (c)(1),
(2), (4) Date: Dec. 21, 2012

(87) PCT Pub. No.: WO2011/083293

PCT Pub. Date: Jul. 14, 2011

(65) Prior Publication Data

US 2013/0086769 A1 Apr. 11, 2013

(30) Foreign Application Priority Data

Jan. 8, 2010 (GB) ..... 100256.6

(51) Int. Cl.
*A47L 9/04* (2006.01)

(52) U.S. Cl.
CPC ..... *A47L 9/04* (2013.01); *A47L 9/0488* (2013.01); *A47L 9/0477* (2013.01); *A47L 9/0411* (2013.01); *A47L 9/0444* (2013.01)

(58) Field of Classification Search
CPC ..... A47L 9/04–9/0494; A47L 11/10–11/2065
USPC ..... 15/383, 384, 4, 52, 1.51, 207.2, 364, 15/366
See application file for complete search history.

(56) References Cited

U.S. PATENT DOCUMENTS

| | | | | | |
|---|---|---|---|---|---|
| 664,135 | A | * | 12/1900 | Dufour | 15/347 |
| 920,136 | A | * | 5/1909 | Henning | 15/52 |
| 1,069,773 | A | * | 8/1913 | Duthie | 15/384 |
| 1,176,990 | A | * | 3/1916 | Scherff | 15/320 |
| 1,325,296 | A | * | 12/1919 | Kern | 15/374 |
| 1,355,978 | A | * | 10/1920 | Jackson | 15/182 |
| 1,391,754 | A | * | 9/1921 | Bair | 15/52 |
| 1,417,768 | A | * | 5/1922 | Radimak | 15/50.3 |
| 1,514,949 | A | * | 11/1924 | Bell et al. | 15/347 |

(Continued)

FOREIGN PATENT DOCUMENTS

| | | |
|---|---|---|
| DE | 396646 | 6/1924 |
| JP | 52-124570 | 9/1977 |

(Continued)

OTHER PUBLICATIONS 3-228721 (Abstract), 1991.*

(Continued)

*Primary Examiner* — Mark Spisich
*Assistant Examiner* — Andrew A Horton
(74) *Attorney, Agent, or Firm* — Morrison & Foerster LLP

(57) ABSTRACT

A cleaner head for a vacuum cleaning appliance includes a main body, a front agitator and a rear agitator, each agitator being rotatable relative to the main body, a mechanism for rotating the front agitator and the rear agitator, and a surface agitating edge located between the front agitator and the rear agitator.

28 Claims, 5 Drawing Sheets

(56) References Cited

U.S. PATENT DOCUMENTS

| | | | | | |
|---|---|---|---|---|---|
| 1,938,068 | A | * | 12/1933 | Deutscher | 15/320 |
| 2,622,254 | A | * | 12/1952 | Mendelson | 15/52 |
| 2,651,803 | A | | 9/1953 | Browne | |
| 2,932,844 | A | * | 4/1960 | O'Connor | 15/321 |
| 3,740,783 | A | * | 6/1973 | Kopecky | 15/3 |
| 3,986,223 | A | * | 10/1976 | Kiefer | 15/1.51 |
| 4,333,205 | A | | 6/1982 | Woodward et al. | |
| 4,419,784 | A | * | 12/1983 | Lex | 15/344 |
| 4,426,751 | A | | 1/1984 | Nordeen | |
| 4,835,807 | A | * | 6/1989 | Swift | 15/1.51 |
| 4,903,369 | A | * | 2/1990 | Kitamura et al. | 15/384 |
| 5,249,332 | A | * | 10/1993 | Wilkerson | 15/384 |
| 6,090,055 | A | * | 7/2000 | Frajdenrajch | 601/7 |
| 6,378,161 | B1 | * | 4/2002 | Parry | 15/256.52 |
| 6,721,990 | B2 | * | 4/2004 | Zahuranec et al. | 15/320 |
| 7,150,068 | B1 | * | 12/2006 | Ragner | 15/340.2 |
| 7,428,402 | B2 | * | 9/2008 | Hays et al. | 399/350 |
| 8,087,117 | B2 | | 1/2012 | Kapoor et al. | |
| 2005/0071948 | A1 | | 4/2005 | Moshenrose | |
| 2006/0191097 | A1 | | 8/2006 | Baumhakel | |
| 2006/0195991 | A1 | | 9/2006 | Baumhakel | |
| 2013/0139349 | A1 | | 6/2013 | Iles et al. | |

FOREIGN PATENT DOCUMENTS

| | | | | |
|---|---|---|---|---|
| JP | 55-126246 | | 9/1980 | |
| JP | 3-228721 | * | 10/1991 | A47L 9/04 |
| JP | 4-332518 | | 11/1992 | |
| JP | 5-228083 | * | 9/1993 | A47L 9/04 |
| JP | 5-290539 | | 11/1993 | |
| JP | 9-10143 | | 1/1997 | |
| JP | 11-9520 | | 1/1999 | |
| JP | 11-56705 | | 3/1999 | |
| JP | 2001-120473 | | 5/2001 | |
| JP | 2001-524337 | | 12/2001 | |
| JP | 2002-143049 | | 5/2002 | |
| JP | 2003-52584 | | 2/2003 | |
| JP | 2006-312066 | | 11/2006 | |
| JP | 2006-314747 | | 11/2006 | |
| JP | 2007-465 | | 1/2007 | |
| JP | 2007-175137 | | 7/2007 | |
| JP | 2007-282769 | | 11/2007 | |
| JP | 2007-289570 | | 11/2007 | |
| JP | 2008-295674 | | 12/2008 | |
| WO | WO-99/37198 | | 7/1999 | |
| WO | WO-2008/099583 | | 8/2008 | |

OTHER PUBLICATIONS 11-056710 (machine translation), 1999.*

5-228083 (Abstract), 1993.*

Search Report mailed Mar. 23, 2010, directed to GB Application No. 1000256.6; 1 page.

Search Report and Written Opinion mailed Mar. 11, 2011, directed to International Application No. PCT/GB2010/052008; 9 pages.

* cited by examiner

CLEANER HEAD

REFERENCE TO RELATED APPLICATIONS

This application is a national stage application under 35 USC 371 of International Application No. PCT/GB2010/052008, filed Dec. 2, 2010, which claims the priority of United Kingdom Application No. 1000256.6, filed Jan. 8, 2010, the entire contents of which are incorporated herein by reference.

FIELD OF THE INVENTION

The present invention relates to a cleaner head for a vacuum cleaning appliance.

BACKGROUND OF THE INVENTION

A vacuum cleaner typically comprises a main body containing dirt and dust separating apparatus, a cleaner head connected to the main body and having a suction opening, and a motor-driven fan unit for drawing dirt-bearing air through the suction opening. The suction opening is directed downwardly to face the floor surface to be cleaned. The dirt-bearing air is conveyed to the separating apparatus so that dirt and dust can be separated from the air before the air is expelled to the atmosphere. The separating apparatus can take the form of a filter, a filter bag or, as is known, a cyclonic arrangement. The present invention is not concerned with the nature of the separating apparatus and is therefore applicable to vacuum cleaners utilizing any of the above arrangements or another suitable separating apparatus.

A driven agitator, usually in the form of a brush bar, is supported in the cleaner head so as to protrude by a small extent from the suction opening. The brush bar is activated mainly when the vacuum cleaner is used to clean carpeted surfaces. The brush bar comprises an elongate cylindrical core bearing bristles which extend radially outward from the core. Rotation of the brush bar may be driven by an electric motor powered by a power supply derived from the main body of the cleaner. The rotation of the brush bar causes the bristles to sweep along the surface of the carpet to be cleaned to loosen dirt and dust, and pick up debris. The suction of air generated by the fan unit of the vacuum cleaner causes air to flow underneath the cleaner head and around the brush bar to help lift the dirt and dust from the surface of the carpet and then carry it from the suction opening through the cleaner head towards the separating apparatus.

When the cleaner head is to be used to clean a hard floor surface, it is desirable to stop the rotation of the cleaner head to prevent the floor surface from becoming scratched or otherwise marked by the moving bristles of the brush bar. For this purpose, a switch may be provided on the cleaner head to enable a user to de-activate the motor driving the rotation of the brush bar before the cleaner head is moved on to the hard floor surface. Alternatively, a sensor may be provided on the bottom surface of the cleaner head for detecting the type of floor surface upon which the cleaner head has been located, and for deactivating the motor depending on the detected type of floor surface.

A plurality of wheels may be provided on the bottom surface of the cleaner head both to facilitate the manoeuvring of the cleaner head over the hard floor surface and to raise the bottom surface of the cleaner head above the floor surface, thereby preventing the floor surface from becoming marked through contact with the bottom surface of the cleaner head.

This raises the suction opening of the cleaner head above the hard floor surface, typically so that it is substantially parallel with that surface.

When the cleaner head is moved on to the hard floor surface, the continued suction of air into the suction opening of the cleaner head enables debris to be lifted from the hard floor surface and into the cleaner head. However, because the brush bar is not rotating the hard floor surface is not agitated by the cleaner hard, with the result that some dust and relatively fine dirt can remain on the hard floor surface.

The suction of air through the suction opening creates a pressure difference between the air passing through the cleaner head and the external environment. The raising of the suction opening of the cleaner head above the hard floor surface means that no seal is formed between the periphery of the suction opening and the floor surface. This in turn means that the pressure difference between the air passing through the cleaner head and the external environment will be relatively low, which has the result of a relatively poor entrainment within the airflow entering the cleaner head of dirt and dust located in crevices in the hard floor surface.

SUMMARY OF THE INVENTION

In a first aspect the present invention provides a cleaner head for a vacuum cleaning appliance, comprising a main body comprising a downwardly-directed suction opening and at least one surface engaging support member, a front agitator and a rear agitator, each agitator being rotatable relative to the main body, and means for rotating the front agitator and the rear agitator, the front agitator comprising a relatively flexible pile and the rear agitator comprising relatively stiff surface engaging means arranged to dislodge matter from the pile of the front agitator, the pile of the front agitator and the at least one surface engaging support member extending downwardly beyond the surface engaging means of the rear agitator.

The present invention provides a cleaner head having two rotatable agitators, each preferably in the form of a rotatable brush bar. A front agitator comprises a relatively flexible pile, similar to the raised or fluffy surface of a carpet, rug, fabric or cloth, whereas a rear agitator comprises relatively stiff surface engaging means. The pile is preferably formed from a plurality of filaments connected to a body of the front agitator, whereas the surface engaging means may comprise a plurality of bristles, filaments or other agitating members, such as at least one strip of material, extending outwardly from the rear agitator. Where the surface engaging means comprise a plurality of bristles, these bristles are preferably arranged in one or more rows of clusters or tufts of bristles.

The main body of the cleaner head comprises at least one surface engaging support member, with the pile of the front agitator and the at least one surface engaging support member extending downwardly beyond the surface engaging means of the rear agitator. Consequently, when the cleaner head is located on a relatively hard floor surface, for example a tiled, laminate, wood or vinyl surface, the surface engaging means of the rear agitator are spaced from that floor surface, whereas the relatively flexible pile of the front agitator can engage the floor surface. This means that the floor surface does not become marked by the surface engaging means as the rear agitator is rotated, and so there is no need to stop the rotation of the rear agitator when it is located on a hard floor surface.

Furthermore, with the rotation of the front agitator relative to the main body, dirt and dust can be dislodged from the floor surface and swept into the cleaner head by the filaments of the pile of the front agitator. As the pile of the front agitator is relatively flexible, scratching or marking of the floor surface can be inhibited. The maximum size of the debris which can be swept into the cleaner head by the front agitator depends on the length of the filaments of the pile, which is preferably in the range from 5 to 15 mm.

The rear agitator is arranged so that the surface engaging means of the rear agitator can dislodge matter from the pile of the front agitator, which can prevent debris such as hair from becoming entangled within the pile of the front agitator and causing the pile to become locally flattened, thereby impairing the performance of the front agitator. We have also found that any matter entangled within the pile of the front agitator during use of the cleaner head on a hard floor surface can be readily transferred to a carpeted floor surface when the cleaner head is manoeuvred on to such a surface while the agitators are rotating. For example, the front agitator and the rear agitator may be arranged so that the surface engaging means of the rear agitator penetrate the pile of the front agitator so that, during rotation of the agitators, the surface engaging means of the rear agitator pass through, or "comb", the pile of the front agitator to dislodge matter from the pile. The maximum distance by which the surface engaging means of the rear agitator penetrate the pile of the front agitator is preferably in the range from 0.5 to 2 mm so that the surface engaging means of the rear agitator do not impede undesirably the rotation of the front agitator.

When the cleaner head is subsequently moved on to a carpeted floor surface, the pile of the front agitator and the at least one surface engaging support member can sink between the fibres of the carpet to bring the surface engaging means of the rear agitator into contact with the carpet fibres. The pile of the front agitator and the surface engaging means of the rear agitator can then both act to dislodge dirt and debris from the fibres of the carpet.

The pile preferably covers at least half of the outer surface of the front agitator, more preferably at least 80% of the outer surface, and even more preferably substantially covers the outer surface of the front agitator so that no patterns of dirt or dust are formed on the floor surface as the cleaner head is manoeuvred over the floor surface. The cleaner head is preferably arranged so that the pile of the front agitator defines a front edge of the suction opening. Where the pile substantially covers the outer surface of the front agitator, the pile can form a seal between the edge of the suction opening and the floor surface during rotation of the front agitator. During use of the vacuum cleaning appliance, this can provide an increased pressure difference between the air passing through the cleaner head and the external environment in comparison to a cleaner head in which the entire periphery of the suction opening is spaced from the floor surface, thereby improving the entrainment within an airflow entering the cleaner head of debris of dirt and dust located in crevices in the hard floor surface.

The rotational axis of the rear agitator is preferably located above the suction opening, and so the main body preferably defines a rear edge of the suction opening. The pile of the front agitator and the at least one surface engaging support member preferably extend downwardly beyond the rear edge of the suction opening. This can enable the rear edge of the suction opening to be spaced from a hard floor surface to inhibit marking of that surface by the rear edge of the suction opening as the cleaner head is manoeuvred over the surface.

The pile preferably comprises filaments formed from one of metallic, carbon fibre, plastics, natural and composite material. Providing the front agitator with an electrically conductive outer surface can enable static electricity residing on a floor surface to be cleaned to be discharged upon contact between the pile and the floor surface. This enables fine dust and powder which would otherwise be attracted to the floor surface to be dislodged from the floor surface.

The surface resistivity of the pile is preferably in the range from $1\times10^{-5}$ to $1\times10^{12}$ Ω/sq (ohms per square). Values of surface resistivity discussed herein are as measured using the test method ASTM D257. The selection of material having a surface resistivity in this range can ensure that any static electricity on the floor surface is effectively discharged by the front agitator. For example, material comprising carbon particles and carbon fibres generally has a surface resistivity in the range from $1\times10^{3}$ to $1\times10^{6}$ Ω/sq, whereas metallic material generally has a much lower surface resistivity, generally lower than 1 Ω/sq. Other static dissipative materials generally have a surface resistivity in the range from $1\times10^{5}$ to $1\times10^{12}$ Ω/sq.

The front agitator preferably comprises a body, and the filaments are preferably woven on to a flexible carrier member located about the body. For example, the carrier member may be in the form of a strip which is wound about the body, preferably so that there are substantially no gaps between the turns of the carrier member. The carrier member is preferably attached to the body using an adhesive.

The surface engaging means of the rear agitator may be provided with a greater stiffness than the pile of the front agitator through having a greater diameter or thickness than the filaments of the pile. For example, the filaments of the pile of the front agitator preferably have a diameter which is less than 100 μm, more preferably less than 50 μm, whereas the surface engaging means may be formed from bristles having a diameter of at least 150 μm.

The surface engaging means of the rear agitator and the pile of the front agitator may be formed from the same material. Alternatively, the surface engaging means of the rear agitator may be formed from a material which is different from that of the pile of the front agitator. Where the rear agitator comprises tufts of bristles, each tuft may be formed from a plurality of types of bristles. For example, each tuft may comprise bristles formed from nylon or similar plastics material, and bristles formed from metallic or composite material having a relatively high electrical conductivity to dissipate static electricity from the pile of the front agitator.

The cleaner head preferably comprises a plurality of surface engaging support members. As the suction of air through the suction opening creates a pressure difference between the air passing through the cleaner head and the external environment, a force acts downwardly on the cleaner head towards the surface to be cleaned. By transferring the force acting on the main body of the cleaner head to a plurality of support members, the resistance to movement of the cleaner head across the floor surface can be relatively low. The support members can be shaped to minimise the resistance generated as the cleaner head is moved across the floor surface. The, or each, support member preferably comprises a moveable member for engaging with the surface to be cleaned. Each moveable member preferably comprises a rolling element for rolling along the surface to be cleaned, and is preferably in the form of a wheel, for example a castor wheel. Alternatively, the rolling element may be in the form of a spherical, cylindrical, or barrel-shaped rolling element. The provision of these moveable members can minimise the resistance to the movement of the support members over a hard floor surface. The rolling elements may comprise an outer covering of felt or other fabric material to prevent any scratching of a relatively delicate hard floor surface as the cleaner head is manoeuvred over such a surface.

The means for rotating the front agitator and the rear agitator is preferably arranged to rotate the front agitator at a first speed, and to rotate the rear agitator at a second speed greater than the first speed. Increasing the speed of the rotation of the rear agitator relative to that of the front agitator can increase the degree of interaction between the surface engaging means of the rear agitator and the pile of the front agitator per revolution of the front agitator. Preferably, the means for rotating the front agitator and the rear agitator is arranged to rotate the front agitator at a speed of v rpm, and to rotate the rear agitator at a speed of Xv rpm, where X≥2. For example the means for rotating the front agitator and the rear agitator may be arranged to rotate the front agitator at a speed in the range from 1000 to 2000 rpm, and to rotate the rear agitator at a speed in the range from 2000 to 5000 rpm. Depending on the relative sizes of the agitators and the arrangement of the surface engaging means of the rear agitator, it may be preferable for the number X not to be an integer so that the locations at which the surface engaging means of the rear agitator interact with the pile of the front agitator vary with each revolution of the front agitator, thereby increasing the volume of the pile of the front agitator through which the surface engaging means of the rear agitator pass during rotation of the agitators.

The means for rotating the front agitator and the rear agitator is preferably arranged to rotate the front agitator and the rear agitator in the same direction. For any given magnitude of the rotational speeds of the front and rear agitators, rotating the agitators in the same direction can increase the relative velocity between the surface engaging means of the rear agitator and the pile of the front agitator at their point of interaction in comparison to an arrangement in which the agitators rotate in opposite directions. In addition to increasing the likelihood of debris being dislodged from the pile of the front agitator, this arrangement can increase the number of times that, for example, a clump of bristles of the rear agitator passes through the pile of the front agitator for each revolution of the front agitator without having to rotate the rear agitator at an excessive speed.

The means for rotating the first agitator and the second agitator may comprise a plurality of motors each for rotating a respective agitator. For example, where each agitator is in the form of a rotatable brush bar, each motor may be located within its respective brush bar. Alternatively, the means for rotating the front agitator and the rear agitator may comprise a motor for rotating both the front agitator and the rear agitator. This motor may be a dedicated motor for rotating the front agitator and the rear agitator, or it may be the vacuum motor that powers the vacuum cleaning appliance. In the former case, the motor may be connected to the agitators by a gear arrangement, or by a plurality of belts. For example, the means for rotating the front agitator and the rear agitator may comprise a first belt connecting the motor to the rear agitator, and a second belt connecting the rear agitator to the front agitator. The motor is preferably located behind the rear agitator to minimize the height of the cleaner head. Where the agitators are driven by the vacuum motor, the means for rotating the agitators may further comprise a clutch located between the vacuum motor and the rear agitator. As an alternative to a motor for driving the agitators, the means for rotating the front agitator and the rear agitator may comprise a turbine driven by an air flow into or out from the cleaner head.

Preferably, the main body comprises an upper surface and a barrier member extending downwardly from the upper surface between the front agitator and the rear agitator. This barrier member can prevent dirt and debris swept from the surface to be cleaned by the front agitator from being thrown out from the front of the cleaner head. The barrier member preferably engages the pile of the front agitator. The barrier member is preferably arranged substantially parallel to the rotational axis of the front agitator, and preferably extends substantially the full length of the front agitator. The barrier member may be formed from metallic material to dissipate any static electricity from the pile of the front agitator.

The cleaner head preferably comprises a surface agitating edge located between the front agitator and the rear agitator. Such an agitating edge can improve the performance of the cleaner head on carpeted floor surfaces, and, through its engagement with a carpeted floor surface, can also prevent the front agitator from becoming too deeply embedded within the fibres of such a floor surface, which would otherwise increase the resistance to the manoeuvring of the cleaner head over such a floor surface. Therefore in a second aspect the present invention provides a cleaner head for a vacuum cleaning appliance, comprising a main body, a front agitator and a rear agitator, each agitator being rotatable relative to the main body, means for rotating the front agitator and the rear agitator, and a surface agitating edge located between the front agitator and the rear agitator.

The surface agitating edge is preferably an angular edge which is preferably defined by the intersection between two surfaces, for example a front surface and a rear surface. These surfaces may be located on a strip which extends across the suction opening, and which may be attached to the opposite sides of the suction opening. At least part of the front surface is preferably inclined forwardly relative to the bottom surface of the cleaner head to guide fibres of a carpeted floor surface therebeneath as the cleaner head is manoeuvred over the carpeted floor surface. The front surface and the rear surface preferably intersect at an acute angle, and so the rear surface may also be inclined forwardly relative to the bottom surface of the cleaner head. Alternatively, the rear surface may be substantially orthogonal to the bottom surface of the cleaner head. To improve agitation the agitating edge preferably has a radius of curvature which is less than 0.5 mm, preferably less than 0.3 mm.

The surface agitating edge preferably extends across the suction opening of the cleaner head. To minimize the height of the cleaner head, the main body preferably comprises an air outlet located towards the rear thereof, and a suction channel extending from the suction opening to the air outlet. The suction channel preferably comprises a front section and a rear section, with the surface agitating edge being located between the front section and the rear section of the suction channel. This can provide the cleaner head with a slim profile. In use, air preferably flows from the front section of the suction channel to the rear section of the suction channel over the surface agitating edge.

The pile of the front agitator preferably extends downwardly beyond the surface agitating edge. As the surface agitating edge may be relatively sharp, the at least one surface engaging support member also preferably protrudes downwardly beyond the surface agitating edge so that the edge is spaced from a hard floor surface as the cleaner head is manoeuvred over such a floor surface. When the cleaner head is moved on to a carpeted floor surface, the pile of the agitator and the at least one surface engaging support member sink into the fibres of the floor surface to bring the agitating edge into contact with those fibres. Where the at least one surface engaging support member comprises a plurality of rolling elements, preferably two of the rolling elements are each located proximate a respective end of the surface agitating edge to ensure that the agitating edge is spaced from a hard floor surface. These two rolling elements may be located at or towards opposing ends of the surface agitating edge, and/or they may be located forwardly or rearwardly of the edge.

Preferably, the main body comprises a front edge located above the rotational axis of the front agitator and the pile of the front agitator extends forwardly beyond the front edge of the main body. By exposing a front portion of the front agitator, the pile of the exposed front portion of the front agitator can function as a relatively soft and flexible front bumper of the cleaner head. Furthermore, the cleaner head can be pushed up against a wall item of furniture or other upstanding object so that the pile of the front agitator can sweep dirt and debris from the parts of the floor surface which adjoin that object. Therefore, in a third aspect the present invention provides a cleaner head for a vacuum cleaning appliance, comprising a main body, a front agitator and a rear agitator, each agitator being rotatable relative to the main body, and means for rotating the front agitator and the rear agitator, wherein the main body comprises a front edge located above the rotational axis of the front agitator and the front agitator comprises a pile which extends forwardly beyond the front edge of the main body.

Preferably, at least part of the front edge, and more preferably substantially all of the front edge, is substantially parallel to the rotational axis of the front agitator.

The cleaner head may be used with either an upright vacuum cleaning appliance, or a cylinder (also referred to as a canister or barrel) vacuum cleaning appliance.

Features described above in connection with the first aspect of the invention are equally applicable to any of the second and third aspects of the invention, and vice versa.

Other preferred features of the invention are set out in the appended claims.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
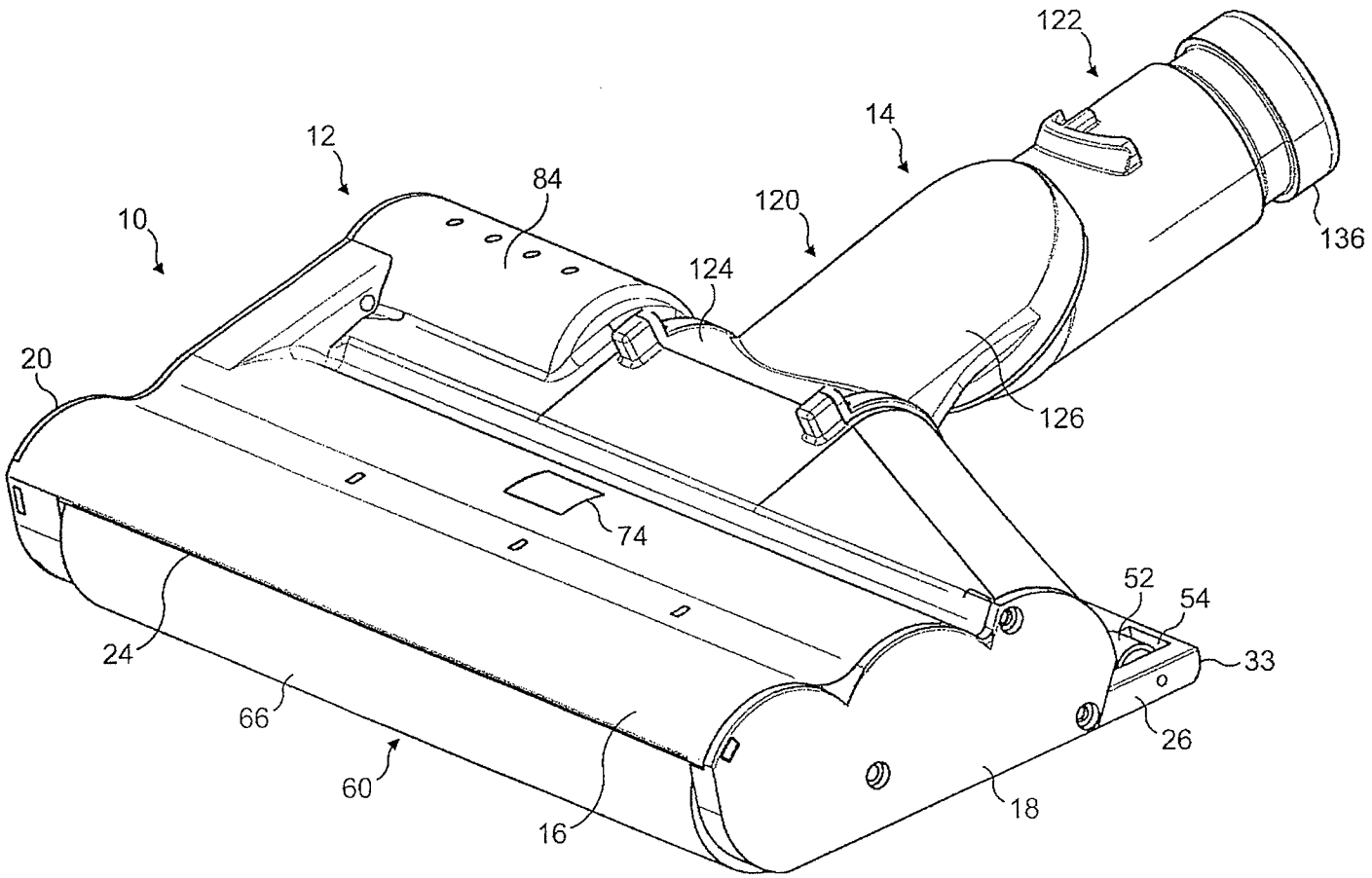
FIG. 1 is a front perspective view, from above, of a cleaner head for a vacuum cleaning appliance.
Figure 2:
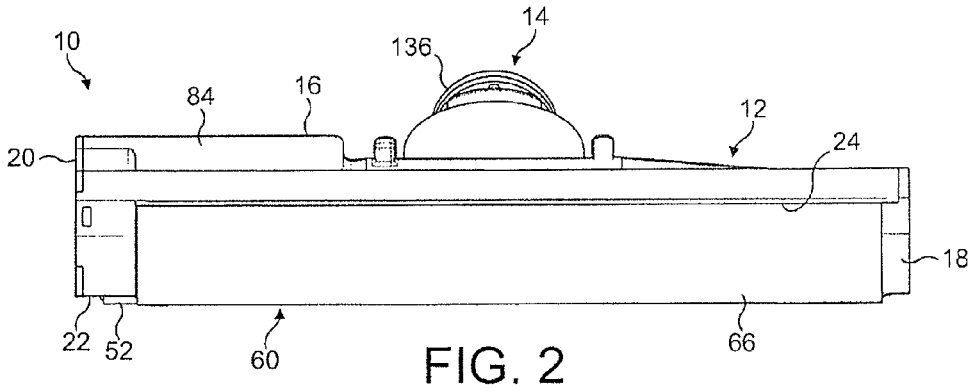
FIG. 2 is a front view of the cleaner head of FIG. 1.

FIGS. 1 to 4 and FIG. 6 illustrate an embodiment of a cleaner head 10 for a vacuum cleaning appliance. In this embodiment, the cleaner head 10 is arranged to be connectable to a wand or hose of a cylinder vacuum cleaning appliance. The cleaner head 10 comprises a main body 12 and a conduit 14 connected to the main body 12. The main body 12 comprises an upper section 16, side plates 18, 20 and a lower section 22. The upper section 16 may be integral with the lower section 22, with the side plates 18, 20 being connected to the upper section 16 and the lower section 22 of the main body 12. The upper section 16 of the main body 12 has a raised front edge 24. A rear portion 26 of the lower section 22 of the main body 12 protrudes rearwardly beyond the upper section 16 of the main body 12.

The lower section 22 of the main body 12 comprises a bottom surface 28 which, in use, faces a floor surface to be cleaned and, as described in more detail below, engages the surface of a carpeted floor surface. The bottom surface 28 is generally planar, and comprises a trailing section 30 and a side section 32. A rear surface 33 of the lower section 22 curves upwardly and rearwardly from the rear of the trailing section 30.

Figure 7:
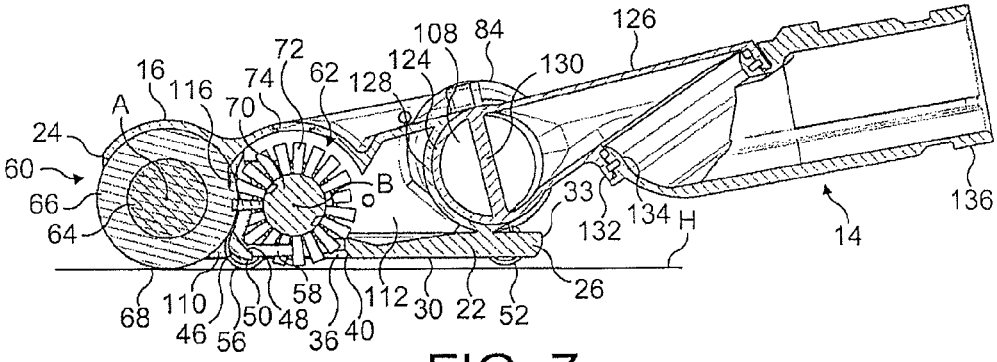
FIG. 7 is a side sectional view taken along line A-A of FIG. 6, with the cleaner head located on a relatively hard floor surface.

The main body 12 comprises a downwardly-facing suction opening 34 through which a dirt-bearing air flow enters the cleaner head 10. The suction opening 34 is generally rectangular in shape, and is delimited in part by relatively short side walls 36, 38 and a relatively long rear wall 40. The side section 32 of the bottom surface 28 comprises the side wall 36, the side plate 18 of the main body comprises the side wall 38, and the trailing section 30 of the bottom surface 28 comprises the rear wall 40. As shown in FIG. 7, the rear wall 40 of the suction opening 34 is curved or inclined forwardly relative to the bottom surface 28 to sweep the fibres of a rug or deeply piled carpeted floor surface beneath the trailing section 30 of the bottom surface 28 as the cleaner head 10 is manoeuvred over the floor surface. The angle of inclination of the rear wall 40 relative to the bottom surface 28 is preferably in the range from 40 to 50°. A rear edge 42 of the suction opening 34 is located at the intersection between the rear wall 40 and the trailing section 30 of the bottom surface 28, and extends substantially uninterruptedly between the side walls 36, 38. The side walls 36, 38 are generally orthogonal to the bottom surface 28.

Figure 3:
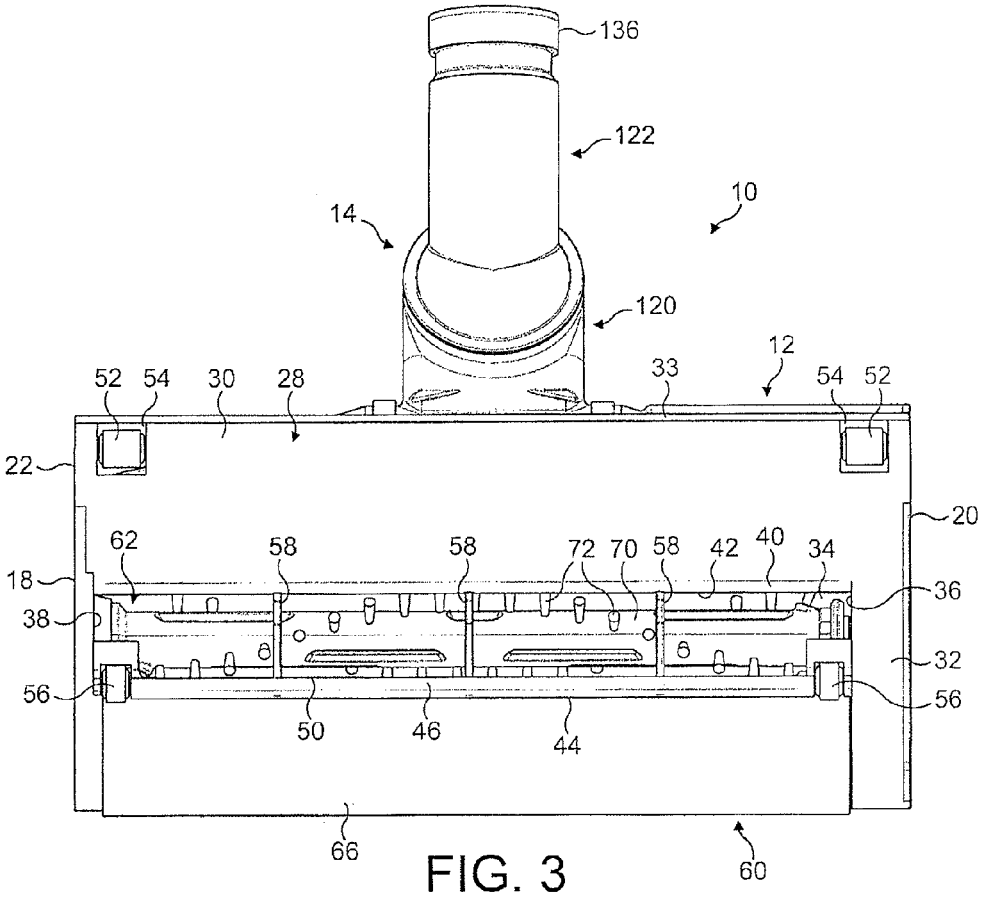
FIG. 3 is a bottom view of the cleaner head of FIG. 1.
Figure 4:
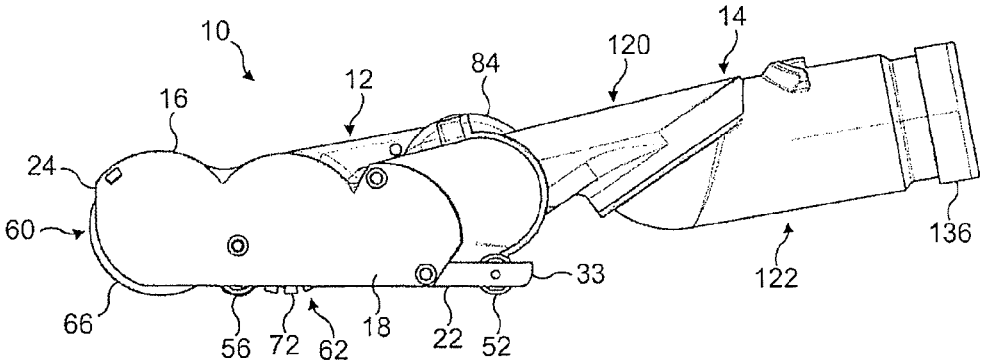
FIG. 4 is a left side view of the cleaner head of FIG. 1.

With particular reference to FIG. 3 and FIG. 7, a surface agitating member 44 extends across the suction opening 34, generally parallel to the rear edge 42 of the suction opening 34. The surface agitating member 44 is connected to the side walls 36, 38 of the suction opening 34. The surface agitating member 44 comprises a front surface 46 and a rear surface 48 which each extend substantially the entire length of the surface agitating member 44, and which intersect to define a surface agitating edge 50. To reduce the resistance to the manoeuvring of the cleaner head 10 over a carpeted surface, the lower part of the front surface 46 of the surface agitating member 44 is also inclined forwardly relative to the bottom surface 28 to sweep the fibres of a rug or deeply piled carpeted floor surface beneath the surface agitating edge 50 as the cleaner head 10 is manoeuvred over the floor surface. The angle of inclination of the front surface 46 of the surface agitating member 44 relative to the bottom surface 28 at the intersection between the front surface 46 and the rear surface 48 is preferably in the range from 10 to 30°. The angle subtended between the front surface 46 and the rear surface 48 at the surface agitating edge 50 is preferably in the range from 50 to 80°. The surface agitating edge 50 is preferably relative sharp, preferably having a radius of curvature less than 0.5 mm.

To prevent the surface agitating edge 50 from scratching or otherwise marking a hard floor surface as the cleaner head 10 is manoeuvred over such a surface, the main body 12 comprises at least one surface engaging support member which serves to space the surface agitating edge 50 from such a surface. In this embodiment, the cleaner head 10 comprises a plurality of surface engaging support members which are each in the form of a rolling element. Two relatively wide rolling elements 52 are each rotatably mounted within a respective aperture 54 formed in the rear portion 26 of the lower section 22 of the main body 12, whereas two relatively narrow rolling elements 56 are each rotatably connected to the surface agitating member 44 and located towards a respective end of the surface agitating member 44 so that the surface agitating edge 50 is located therebetween. As illustrated in FIG. 7, the rolling elements 52, 56 protrude downwardly beyond both the bottom surface 28 of the lower section 22 of the main body 12 and the surface agitating edge 50 so that when the cleaner head 10 is located on a hard floor surface H with the rolling elements 52, 56 engaging that surface, the bottom surface 28 of the main body 12 and the surface agitating edge 50 are spaced from that surface.

Returning to FIG. 3, a plurality of rug strips 58 for guiding the movement of the cleaner head 10 over a rug or deeply piled carpeted floor surface extend across part of the suction opening 38. The rug strips 58 are connected to, and preferably integral with, the surface agitating member 44, and extend from the surface agitating member 44 to the rear wall 40 of the suction opening 38, to which the rug strips 58 are connected. The rug strips 58 are substantially parallel to the side walls 36, 38 of the suction opening 34.

The cleaner head 10 comprises a front agitator 60 and a rear agitator 62 located behind the front agitator 60 for agitating dirt and dust located on a floor surface. In this embodiment, each of the agitators 60, 62 comprises a brush bar which is rotatable relative to the main body 12 about a rotational axis. The rotational axes A, B of the agitators 60, 62 are substantially parallel, and are also substantially parallel to the front edge 24 of the main body 12, the rear edge 42 of the suction opening 34 and the surface agitating edge 50.

The front agitator 60 and the rear agitator 62 are dissimilar. With reference again to FIGS. 3 and 7, the front agitator 60 comprises a generally cylindrical body 64 which rotates about the longitudinal axis thereof. The body 64 has an outer surface comprising a pile 66 formed from relatively flexible filaments. In this example, the pile 66 is similar to the raised or fluffy surface of a carpet, rug or cloth, and comprises filaments woven on to a fabric carrier member (not shown) attached to the body 64, for example using an adhesive. The length of the filaments of the pile 66 is preferably in the range from 5 to 15 mm. The fabric carrier member may be in the form of a strip wound on to the body 64 so that the pile 66 is substantially continuous, substantially covering the outer surface of the body 64. Alternatively, the carrier member may be in the form of a cylindrical sleeve into which the body 64 is inserted.

The length of the filaments of the front agitator 60 is selected so that the pile 66 protrudes downwardly beyond the bottom surface 28 of the main body 12 and the surface agitating edge 50, and at least as far as the rolling elements 52, 56. Consequently, when the cleaner head 10 is located on a hard floor surface H, as illustrated in FIG. 7, the pile 66 engages the hard floor surface H to enable dirt and debris to be swept from the hard floor surface H with rotation of the front agitator 60 relative to the main body 12. With the pile 66 substantially covering the body 64 of the front agitator 60, the pile 66 can engage and form a seal with the hard floor surface H during rotation of the front agitator 60. The pile 66 therefore defines the front edge 68 of the suction opening 34 of the cleaner head 10. The front edge 68 can remain in contact with a floor surface as the cleaner head 10 is manoeuvred over the floor surface so that, in use, a pressure difference established between the air passing through the cleaner head 10 and the external environment is greater than that established in a cleaner head 10 in which the entire periphery of the suction opening is spaced from the floor surface, thereby improving the entrainment within an airflow entering the cleaner head 10 of debris of dirt and dust located in crevices in the hard floor surface H.

As mentioned earlier, the upper section 16 of the main body 12 has a raised front edge 24. The front agitator 60 is arranged so that the rotational axis A of the front agitator 60 is located both behind and beneath the front edge 24. The length of the filaments of the pile 66 of the front agitator 60 is selected so that the pile 66 extends forwardly beyond the front edge 24 of the main body 12. This can be seen most clearly in FIGS. 4 and 5. As a result, the pile 66 of the front agitator 60 provides the forward extremity of the cleaner head 10. The pile 66 can therefore act as a relatively soft and flexible front bumper for the cleaner head 10, meaning that the front of the cleaner head 10 can engage walls, furniture or other such objects upstanding from a floor surface without marking these objects. Furthermore, depending on the distance by which the pile 66 protrudes forwardly from the front edge 24 of the main body 12 the cleaner head 10 can be pushed forward against an upstanding object so that the pile 66 can sweep dirt and debris from the portion of the floor surface adjoining the upstanding object before the front edge 24 comes into contact with the upstanding object.

The filaments of the front agitator 60 may be formed from one of a plastics material or a natural material. Alternatively, at least some of the filaments of the front agitator 60 may be formed from carbon fibre material, metallic material, or other composite material. Consequently, in this latter case the surface resistivity of the filaments of the pile 66 may be in the range from $1\times10^{-5}$ to $1\times10^{12}$ Ω/sq. Providing the front agitator 60 with a flexible, electrically conductive outer surface can enable static electricity residing on a floor surface to be cleaned to be discharged upon contact between the front agitator 60 and the floor surface. In turn, this can enable fine dust and powder which would otherwise be attracted to the floor surface to be dislodged from the floor surface by the front agitator 60.

The rear agitator 62 also comprises a generally cylindrical body 70 which rotates about the longitudinal axis thereof. Instead of a relatively flexible pile formed from filaments being located about the body 70, the rear agitator 62 comprises relatively stiff surface engaging elements which in this embodiment are in the form of relatively stiff bristles 72 protruding radially outwardly from the body 70. As shown in FIG. 3, the bristles 72 are arranged in a plurality of clusters arranged in a helical formation at regular intervals along the body 70.

The rear agitator 62 is arranged so that, during rotation of the rear agitator 62 about its rotational axis B, the bristles 72 protrude downwardly through the suction opening 34 of the main body 12, between the rug strips 58 and beyond the surface agitating edge 50. However, as illustrated in FIG. 7 the rear agitator 62 is also arranged so that the bristles 72 do not protrude downwardly beyond the rolling elements 52, 56 or the pile 66 of the front agitator 60. Consequently, when the cleaner head is located on a relatively hard floor surface H, the bristles 72 of the rear agitator are spaced from the floor surface H. This means that the rear agitator 62 can be rotated simultaneously with the front agitator 60 irrespective of the nature of the floor surface on which the cleaner head 10 is located without the floor surface being scratched or otherwise marked by the bristles 72 of the rear agitator 62. This can enable a relatively simple drive mechanism to be used to rotate both the front agitator 60 and the rear agitator 62, as described in more detail below.

As also shown in FIG. 7, the rear agitator 62 is arranged so that the bristles 72 engage and move through the pile 66 of the front agitator 60 during use of the cleaner head 10. This can enable the bristles 72 of the rear agitator 62 to dislodge matter which may become caught or entangled between or about the filaments of the pile 66 of the front agitator 60. In addition to enabling the exposed front portion of the front agitator 60 to maintain a relatively clean appearance, the removal of dirt or debris from the pile 66 of the front agitator 60 can enable the cleaner head 10 to maintain a relatively uniform cleaning performance, for example through preserving the seal formed between the front edge 68 of the suction opening 34 and the floor surface.

The bristles 72 of the rear agitator 62 are preferably formed from an electrically insulating, plastics material, such as nylon, and so may have a surface resistivity in the range from $1\times10^{12}$ to $1\times10^{16}$ Ω/sq. Alternatively, at least some of the bristles 72 may be formed from a metallic or composite material and so may have a surface resistivity within the aforementioned range for the pile 66 of the front agitator 60 in order to discharge any static electricity residing on a carpeted floor surface and/or, if the pile 66 is formed from a natural or electrically insulating material, on the pile 66 of the front agitator 60.

Figure 6:
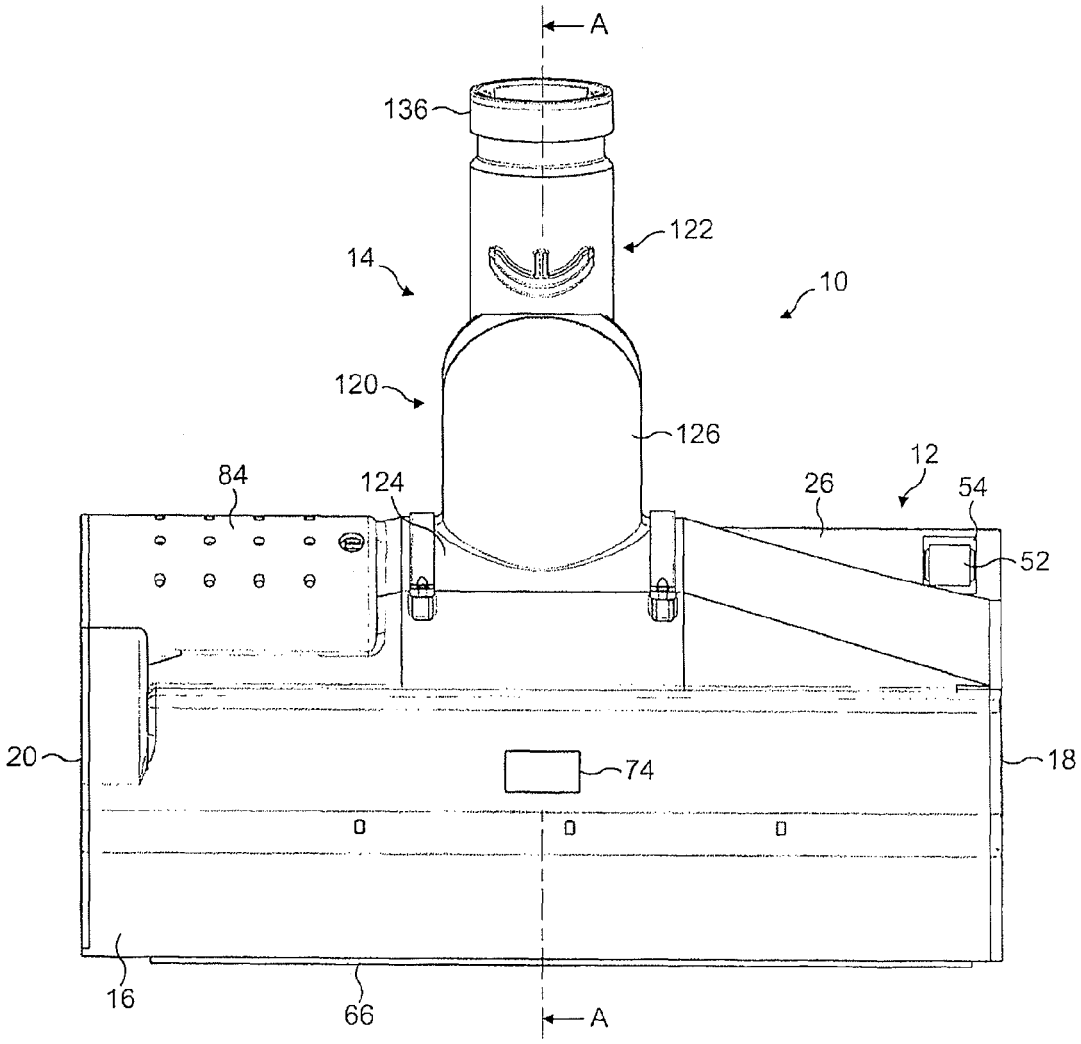
FIG. 6 is a top view of the cleaner head of FIG. 1.

Optionally, a window 74 is located in the upper section 16 of the main body 12 to allow a user to view the rear agitator 62 during use of the cleaner head 10 to check that the rear agitator 62 has not become so entangled with hair or other fibres as to impair the rotation thereof relative to the main body 12. As illustrated in FIG. 6, the window 74 may be a relatively small window located centrally on the upper surface 16 of the main body 12.

Alternatively, the size of the window 74 may be increased to enable a user to view a greater proportion of the rear agitator 62 during use of the cleaner head 10.

Figure 5:
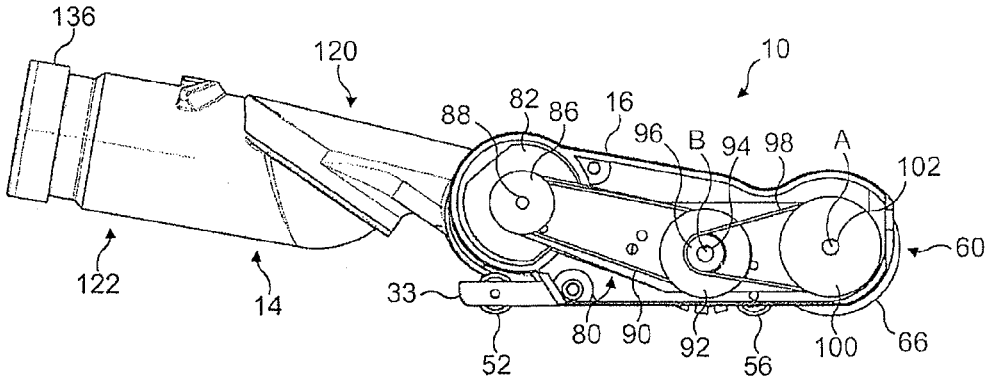
FIG. 5 is a right side view of the cleaner head of FIG. 1, with part of the main body removed.

FIG. 5 illustrates a drive mechanism 80 for rotating the front agitator 60 and the rear agitator 62 relative to the main body 12. The drive mechanism 80 comprises a motor 82 located within a motor housing 84 formed in the upper section 16 of the main body 12, and which is located behind the rear agitator 62. The motor 82 is supplied with electrical power by leads (not shown) which pass through the conduit 14 and terminate with terminals located adjacent the air outlet of the conduit 14. These terminals are connectable to a power leads located, in the case of an upright vacuum cleaning appliance, in the main body of the vacuum cleaning appliance or, in the case of a cylinder vacuum cleaning appliance, at the end of a wand connected by a hose to the main body of the appliance.

The drive mechanism 80 further comprises a first drive member 86, preferably in the form of a pulley, mounted on a first drive shaft 88. The first drive shaft 88 is connected to the motor 80. The first drive member 86 is connected by a first drive belt 90 to a first driven member 92, also preferably in the form of a pulley. The first driven member 92 is mounted on a second drive shaft 94 for rotation about an axis which is substantially parallel to the rotational axis of the first drive shaft 88. One of the first driven member 92 and the second drive shaft 94 is connected to one end of the body 70 of the rear agitator 62 so as to rotate the rear agitator 62 about its rotational axis B. The other end of the body 70 of the rear agitator 62 is rotatably supported by formations disposed on the side plate 18 of the main body 12.

The drive mechanism 80 also comprises a second drive member 96, preferably in the form of a pulley, mounted on the second drive shaft 94 for rotation with the first driven member 92. The second drive member 96 has a smaller radius than the first driven member 92. The second drive member 96 is connected by a second drive belt 98 to a second driven member 100, also preferably in the form of a pulley. The second driven member 100 has a larger radius than the second drive member 96. The second driven member 100 is mounted on a third drive shaft 102 for rotation about an axis which is substantially parallel to the rotational axis of the first drive shaft 88. One of the second driven member 100 and the third drive shaft 102 is connected to one end of the body 64 of the front agitator 60 so as to rotate the front agitator 60 about its rotational axis A. Similar to the rear agitator 62, the other end of the body 64 of the front agitator 60 is rotatably supported by formations disposed on the side plate 18 of the main body 12.

The arrangement of the drive mechanism 80 is such that, upon activation of the motor 80, the front agitator 60 and the rear agitator 62 rotate in the same direction so as to sweep dirt and debris on a floor surface rearwardly towards the conduit 14. The arrangement of the drive mechanism 80 is also such that the front agitator 60 and the rear agitator 62 are rotated at different speeds. The front agitator 60 is rotated at a first speed, and the rear agitator 62 at a second speed which is greater than the first speed. In this embodiment the front agitator 60 is rotated at a speed of around 1,500 rpm, and the rear agitator 62 is rotated at a speed of around 3,700 rpm. However, the speeds of rotation of the front agitator 60 and the rear agitator 62 are not restricted to these values; the speed of rotation of the rear agitator 62 is preferably at least twice the speed of rotation of the front agitator 60, and may be as much as three times or four times the speed of rotation of the front agitator 60.

Returning to FIG. 7, the main body 12 comprises an air outlet 108 located towards the rear of the main body 12 for conveying a dirt-bearing air flow to the conduit 14. To minimise the height of the cleaner head 10, the air outlet 108 is preferably located behind the rear agitator 62. The main body 12 also comprises a suction channel which extends from the suction opening 34 to the air outlet 108. The suction channel can be considered as being divided into a front section 110 and a rear section 112, with the surface agitating edge 50 being located between the front section 110 and the rear section 112 of the suction channel. In use, a dirt-bearing air flow passes from the front section 110 to the rear section 112 of the suction channel over the surface agitating edge 50.

Figure 8:
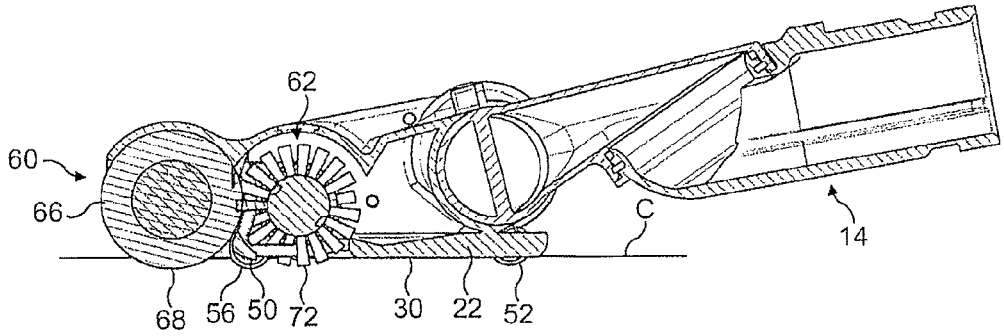
FIG. 8 is the same view as FIG. 7, but with the cleaner head located on a carpeted floor surface.

With the front edge 24 of the main body 12 being raised above the rotational axis A of the front agitator 60, there is a risk that dirt and debris which has been swept from the floor surface by the front agitator 60 may be subsequently thrown forward from the front of the cleaner head 10 if it is not dislodged by the bristles 72 of the rear agitator 62 and drawn into the airflow passing through the cleaner head 10. In view of this, the upper section 16 of the main body 12 comprises a barrier member 116 which protrudes downwardly from the upper section 16 towards the suction opening 34. The barrier member 116 is shown in FIGS. 7 and 8. The barrier member 116 is located between the front agitator 60 and the rear agitator 62, and preferably extends substantially the entire length of the front agitator 60. As illustrated, the barrier member 116 extends into the pile 66 of the front agitator 60 to dislodge debris and dirt from between the filaments of the pile 66 for entrainment within the air flow.

Returning to FIGS. 1 and 6, the conduit 14 comprises a front section 120 and a rear section 122. To facilitate the manoeuvring of the cleaner head 10 over a floor surface, the front section 120 is pivotably connected to the main body 12 of cleaner head for movement relative thereto about a first pivot axis which is substantially parallel to the rotational axes A, B of the front agitator 60 and the rear agitator 62. The rear section 122 of the conduit 14 is connected to the neck 126 of the front section 50 of the conduit 14 for pivotal movement relative thereto about a second pivot axis angled to the first pivot axis.

The front section 120 comprises a head 124 pivotably connected to the main body 12, and a neck 126 extending from the head 124 to the rear section 122 of the conduit 14. The head 124 is positioned within a recess located centrally in the upper section 16 of the main body 12. The head 124 has a substantially cylindrical outer surface which is open at each end thereof to receive an air flow from the rear section 112 of the suction channel, and is connected to the upper section 16 so that the head 124 is free to rotate about its longitudinal axis. The bottom of the recess within the upper section 16 of the main body 12 is delimited by a curved support surface 128 for supporting the head 124. The support surface 128 preferably has a radius of curvature which is substantially the same as that of the outer surface of the head 124. In addition to supporting the head 124, the support surface 128 also serves to guide fluid into the head 124 from the rear section 112 of the suction channel.

The neck 126 is connected to the head 124 substantially midway between the open ends of the head 124, and in this embodiment is integral with the head 124. The neck 126 extends away from the head 124 in a direction which is substantially orthogonal to the longitudinal axis of the head 124. Consequently, as air passes through the head 124 and into the neck 126, the air changes direction by around 90°. To reduce turbulence within the head 124, the head 124 comprises two guide surfaces (not shown) each for guiding fluid entering the head 124 through a respective one of the open ends towards the neck 126. The guide surfaces are preferably integral with the inner surface of the head 124, and arranged so that each guide surface curves away from the inner surface of the head 124 towards the neck 126 to meet the other guide surface at an apex 130 extending across the bore of the head 124.

The connection between the front section 120 and the rear section 122 of the conduit 14 is effected by the connection of the air outlet 132 of the neck 126 of the front section 120 to the air inlet 134 of the rear section 122. The air outlet 132 of the neck 126 is substantially cylindrical, and is angled downwardly (as illustrated in FIG. 7) towards a floor surface to be cleaned. The air inlet 134 of the rear section 122 is also substantially cylindrical and is angled upwardly (as also illustrated in FIG. 7) away from the floor surface.

The rear section 122 of the conduit 14 comprises an air outlet 136 which is connectable to a wand, hose or other such duct of a cylinder vacuum cleaning appliance which comprises dirt and dust separating apparatus and a motor-driven fan unit for drawing dirt-bearing air into the main body 12 of the cleaner head 10. During use of the vacuum cleaning appliance, an air flow is drawn into the cleaner head 10 through the suction opening 34. The air flow passes through the suction channel to the air outlet 108 of the main body 12. The air flow then passes through the conduit 14 and enters, for example, the wand of the cleaning appliance. The motor 82 of the drive mechanism 80 is activated to rotate simultaneously the front agitator 60 and the rear agitator 62.

When the cleaner head 10 is located on a relatively hard floor surface H, as illustrated in FIG. 7, a pressure difference is generated between the air passing through the cleaner head 10 and the external environment. This pressure difference generates a force which acts downwardly on the main body 12 of the cleaner head 10 towards the floor surface. As the rolling elements 52, 56 and the pile 66 of the front agitator 60 protrude downwardly beyond the surface agitating edge 50 and the bristles 72 of the rear agitator, only the rolling elements 52, 56 and the pile 66 of the front agitator 60 engage the hard floor surface H. The bottom surface 28 of the main body 12 is spaced from the hard floor surface H, and so debris located on the hard floor surface H can become entrained within the air flow generated by the cleaning appliance, with the result that a dirt-bearing air flow can flow unrestrictedly beneath the bottom surface 28 of the main body 12 and into the suction channel through the suction opening 34. With the rotation of the front agitator 60 relative to the main body 12, the pile 66 of the front agitator 60 is able to sweep dirt and debris from the hard floor surface H into the front section 110 of the suction channel. This debris can be thrown rearwardly by the pile 66 of the front agitator 60 and become entrained within the air flow passing through the suction channel to the air outlet 108. In the event that any debris has become caught or otherwise trapped between the filaments of the pile 66, this debris can be dislodged from the filaments by the rotating bristles 72 of the rear agitator 62 or the barrier member 116.

When the cleaner head 10 is located on a carpeted floor surface C, as illustrated in FIG. 8, the rolling elements 52, 56 and the pile 66 of the front agitator 60 are pushed into the fibres of the carpeted floor surface C under the weight of the cleaner head 10 and the force acting downwardly on the main body 12. As the support members 52, 56 sink into the carpet, the bottom surface 28 of the main body 12 comes into contact with the carpeted floor surface C. As the surface agitating edge 50 and the bristles 72 of the rear agitator 62 protrude downwardly beyond the bottom surface 28 of the main body 12, dirt and dust within the fibres of the carpeted floor surface C can be agitated by the surface agitating edge 50 and the rear agitator 62, and become entrained within the air flow drawn into the suction channel.

The invention claimed is:

1. A cleaner head for a vacuum cleaning appliance, comprising:

a main body;

a front agitator and a rear agitator, each agitator being rotatable relative to the main body;

at least one motor for rotating the front agitator and the rear agitator; and a surface agitating edge located between the front agitator and the rear agitator, wherein the front agitator and the rear agitator are dissimilar, the front agitator comprises a pile which covers at least 80% of the outer surface of the front agitator and which extends downwardly beyond the surface agitating edge, and the at least one motor for rotating the front agitator and the rear agitator is arranged to rotate the front agitator and the rear agitator in the same direction.

2. The cleaner head of claim 1, wherein the surface agitating edge is an angular edge.

3. The cleaner head of claim 1, wherein the surface agitating edge has a radius of curvature which is less than 0.5 mm.

4. The cleaner head of claim 1, wherein the main body comprises a suction opening, and wherein the surface agitating edge extends across the suction opening.

5. The cleaner head of claim 4, wherein the main body comprises an air outlet located towards the rear thereof, and a suction channel extending from the suction opening to the air outlet.

6. The cleaner head of claim 5, wherein the suction channel comprises a front section and a rear section, the surface agitating edge being located between the front section and the rear section of the suction channel.

7. The cleaner head of claim 6, wherein, in use, air flows from the front section of the suction channel to the rear section of the suction channel over the surface agitating edge.

8. The cleaner head of claim 4, wherein the front agitator defines a front edge of the suction opening.

9. The cleaner head of claim 8, wherein the main body defines a rear edge of the suction opening.

10. The cleaner head of claim 1, wherein the pile comprises filaments formed from one of metallic, carbon fibre, plastics, natural and composite material.

11. The cleaner head of claim 10, wherein the front agitator comprises a body, and the filaments are woven on to a flexible carrier member located about the body.

12. The cleaner head of claim 11, wherein the carrier member is wound about the body.

13. The cleaner head of claim 12, wherein the carrier member is adhered to the body.

14. The cleaner head of claim 1, wherein the main body comprises at least one surface engaging support member which protrudes downwardly beyond the surface agitating edge.

15. The cleaner head of claim 14, wherein the at least one surface engaging support member comprises a plurality of rolling elements.

16. The cleaner head of claim 15, wherein two of said plurality of rolling elements are each located proximate a respective end of the surface agitating edge.

17. The cleaner head of claim 15, wherein each rolling element comprises a wheel.

18. The cleaner head of claim 1, wherein the rear agitator comprises one of a plurality of bristles and at least one strip of material.

19. The cleaner head of claim 18, wherein at least some of the bristles are formed from material having a surface resistivity in the range from $1\times10^{-5}$ to $1\times10^{12}$ Ω/sq.

20. The cleaner head of claim 18, wherein at least some of the bristles and said at least one strip of material is formed from one of metallic, carbon fibre, natural and composite material.

21. The cleaner head of claim 1, wherein the at least one motor for rotating the front agitator and the rear agitator is arranged to rotate the front agitator at a first speed, and to rotate the rear agitator at a second speed greater than the first speed.

22. The cleaner head of claim 21, wherein the at least one motor for rotating the front agitator and the rear agitator is arranged to rotate the rear agitator at at least twice the speed of the front agitator.

23. The cleaner head of claim 21, wherein the at least one motor for rotating the front agitator and the rear agitator comprises a motor for rotating both the front agitator and the rear agitator.

24. The cleaner head of claim 23, wherein the at least one motor for rotating the front agitator and the rear agitator comprises a first belt connecting the motor to the rear agitator, and a second belt connecting the rear agitator to the front agitator.

25. The cleaner head of claim 23, wherein the motor is located behind the rear agitator.

26. The cleaner head of claim 1, wherein the main body comprises an upper surface and a barrier member extending downwardly from the upper surface between the front agitator and the rear agitator.

27. The cleaner head of claim 26, wherein the barrier member engages the front agitator.

28. The cleaner head of claim 1, wherein each of the front agitator and the rear agitator is in the form of a rotatable brush bar.

* * * * *